United States Patent [19]

Ericsson

[11] 4,193,344

[45] Mar. 18, 1980

[54] SILK SCREEN PRINTING MACHINE

[75] Inventor: Sylve J. D. Ericsson, Tumba, Sweden

[73] Assignee: Svecia Silkscreen Maskiner AB, Norsborg, Sweden

[21] Appl. No.: 837,425

[22] Filed: Sep. 28, 1977

[30] Foreign Application Priority Data

Sep. 28, 1976 [SE] Sweden ..... 7610725

[51] Int. Cl.[2] ..... B05C 17/06

[52] U.S. Cl. ..... 101/126

[58] Field of Search ..... 101/115, 123, 124, 126, 101/127.1, 128.

[56] References Cited

U.S. PATENT DOCUMENTS

| | | | |
|---|---|---|---|
| 2,936,705 | 5/1960 | Hall | 101/123 |
| 3,303,777 | 2/1967 | Feier et al. | 101/126 X |
| 3,505,951 | 4/1970 | Gartrell | 101/123 |
| 3,915,088 | 10/1975 | Svantesson et al. | 101/124 |

*Primary Examiner*—E. H. Eickron

*Attorney, Agent, or Firm*—Burns, Doane, Swecker & Mathis

[57] ABSTRACT

An improved silk-screen printing machine is provided which includes a squeegee and means for urging the squeegee against an elastic stencil and the material to be printed. Means are also provided to impart movement to the stencil relative to the material to be printed upon during the printing process in order to compensate for any geometric printing error which would normally occur during the printing process.

4 Claims, 13 Drawing Figures

SILK SCREEN PRINTING MACHINE

The present invention relates to a silk-screen printing machine or printer, and in particular to a printer of the kind having a squeegee and means for urging the squeegee against a stencil and the material to be printed, said material resting on a printing surface or a platen during the actual printing stage of a printing operation. The squeegee may either be arranged for movement across a stencil secured to a frame, or the squeegee may be fixedly arranged and the stencil and frame displaceably arranged.

It is known that such silk-screen printers constantly give rise to geometric printing errors. The phase geometric printing error means that the pattern formed on the stencil is not transferred precisely to the material to be printed, but that the pattern is altered geometrically, (i.e. distorted) by this transfer. The reason for this is that the stencil comprises an elastic material and as the squeegee is pressed against the stencil and is moved thereacross, so as to cause relative movement between the squeegee and the stencil, the friction occurring between the squeegee and the stencil will cause the stencil to stretch. When the squeegee is moveable and the stencil fixed relative thereto, the stencil will stretch in the same direction as the squeegee is moved, while in the case of a fixed squeegee and a moveable stencil this stretch takes place in the direction opposite to that in which the stencil moves. Normally, measures are taken such that the geometric printing error is negligible at the beginning of the printing stage, but increases successively to reach a maximum at the end of the printing stage. In practice it has been established that the maximum geometric printing error can be in the order of magnitude of 1 mm, but normally will be within the range 0.3–0.7 mm. The geometric printing error which occurs perpendicularly to the path along which the squeegee moves is negligible.

It has been found that such geometric printing errors can give rise to serious complications, particularly in the case of multi-color printing and in the printing of circuit-cards on which conductor paths are to be printed. Thus it can be mentioned that when coating a circuit card with a material which prevents solder from spreading over the card in a subsequent soldering operation, the coating must be exactly positioned so that those holes which are formed in the card for mounting the card components can be completely and precisely surrounded by said layer of material. The subsequent soldering operation can only be performed satisfactorily so as to provide a reliable circuit card when this coating is applied precisely.

The present invention is based upon the concept of compensating for geometrical errors in the pattern of the stencil caused by pressure of the squeegee against the stencil and the relative movement therebetween, i.e. the stretch to which the stencil is subjected. Compensation is provided for by allotting to the platen surface and/or the stencil a relative movement directed towards the direction of stretch through a distance corresponding to the extent of said stretch or at least corresponding substantially thereto.

The invention will be more readily understood and further features thereof made more readily apparent, by reference to the accompanying drawings, in which.

The present invention can be applied both to a fixed squeegee and a moveable stencil (FIGS. 9–13) and a moveable squeegee and a fixed stencil (FIGS. 1–8). Initially, however, the subsequent description will refer to the more conventional embodiment which includes a moveable squeegee and a fixed stencil mounted in a frame.

Figure 1:
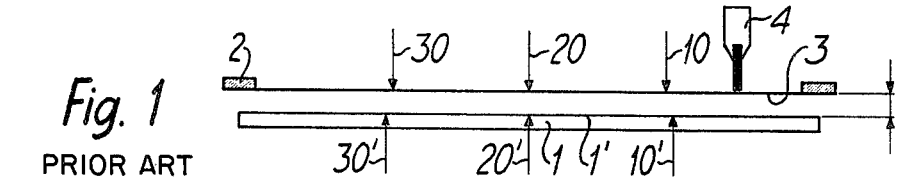
Fig. 1 PRIOR ART
FIG. 1 illustrates those conditions under which a geometric printing error could be obtained.

In FIG. 1 there is depicted a printing table or platen 1 and a frame 2 having a stencil 3 mounted therein and placed over the platen, the frame 2 being shown in the printing position. The stencil 3 is made of an elastic material and has a pattern thereon shown by reference points 10, 20 and 30. When the squeegee 4 is pressed downwardly against the printed surface 1′, the stencil stretches and the reference point 10 will not move straight down towards the surface of the platen and the material placed thereon for printing, but will be moved to the right to position 10′ as shown in the Figure. The left part of the stencil will stretch more than the right part. At reference point 20, no displacement occurs since the right part and the left part of the stencil stretch the same amount, and hence the position 20′ will lie directly under the reference point 20. On the other hand, the reference point 30 will be displaced to the left, to the position shown at 30′. This change in the pattern from the stencil 3 to the printing surface 1′ is termed a geometric printing error.

It is, of course, possible to displace the material to be printed slightly to the right, whereupon the geometric error will be insignificant at the beginning of the printing stage but will increase towards the end of said stage.

Figure 2:
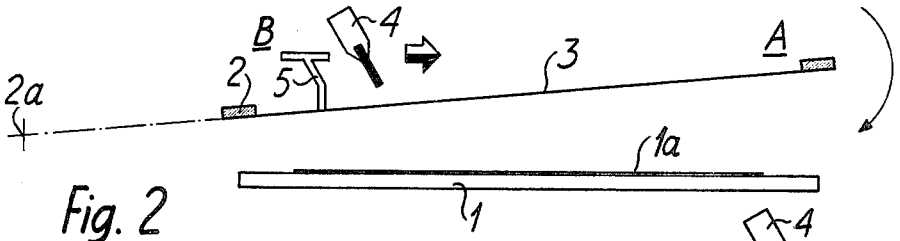
Fig. 2 PRIOR ART
FIG. 2 is a simplified side view of a printing platen with associated frame for holding a stencil, and a moveable squeegee and ink-dispenser capable of being moved to the starting position of the printing stage.
Figure 3:
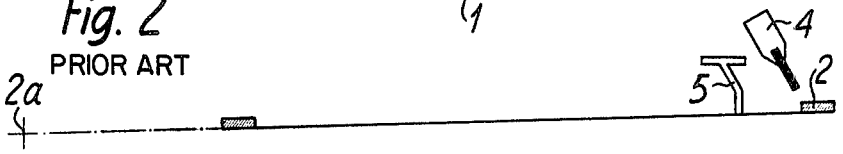
Fig. 3 PRIOR ART
FIG. 3 illustrates the moveable squeegee and the ink-dispenser in the starting position of a printing stage.
Figure 4:
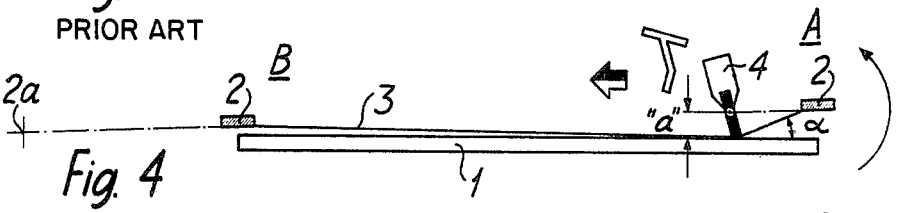
Fig. 4 PRIOR ART
FIG. 4 illustrates the moveable squeegee in co-operation with the stencil and platen and the release angle obtained therewith.
Figure 5:
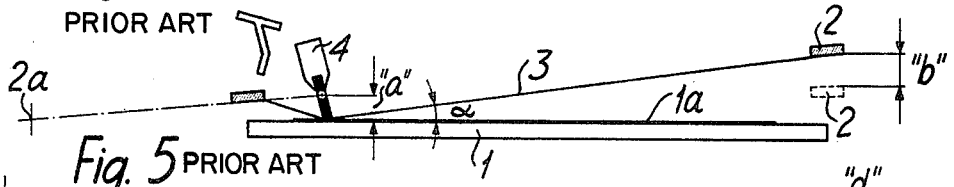
Fig. 5 PRIOR ART
FIG. 5 illustrates the moveable squeegee in co-operation with the stencil and the platen in the terminal position of the printing stage and the release angle formed therewith.

FIG. 2 is a greatly simplified view of a known silk-screen printer. The printer is provided with a horizontal, stationary platen 1 having an associated printing surface. Above the platen 1 there is arranged a frame 2 intended to hold a stencil 3. The stencil 3 carries the pattern which is to be transferred to the material to be printed. This material to be printed is identified by the reference 1*a* and is placed on the platen 1. The frame 2 can be raised and lowered relative to the platen 1 by means not shown in a manner such that when the frame adopts the position shown in FIG. 1, the material 1*a* can be placed in an exact position on the printing surface of the platen 1. The frame is lowered immediately prior to the actual printing stage. The printer also comprises a squeegee 4 and an ink dispenser 5. The ink-dispenser 5 is arranged to dispense ink over the stencil 3 during movement from position B in FIG. 2 to position A. This takes place when the frame 2 is located in the upper position. FIG. 3 depicts the squeegee 4 and ink dispenser 5 after having moved to position A. FIG. 4 depicts the frame 2 as being located at a distance "a" from the upper surface of the platen 1. As the squeegee 4 moves in the direction of the arrow towards the position B, the frame 2, during displacement of the squeegee 4, will be raised from the position shown in dash-lines in FIG. 5 to the position shown in full lines therein, which means that the release or clearance angle "$\alpha$" can either be constant during the printing process or is at least of sufficient magnitude to ensure good release or clearance between the stencil and the material 1*a* and/or the platen 1.

This arrangement, however, results in the occurrence of tensile stresses in the stencil 3, causing the same to stretch, with these tensile stresses causing the pattern on the stencil 3 to be distorted and to give rise to a geometric printing error when the pattern is transferred to the material 1*a*. This geometric printing error is a result of the fact that the print transferred to the material 1*a* is of greater extension than the pattern on the stencil 3. This distortion is described in the description made with reference to FIG. 1.

Figure 6:
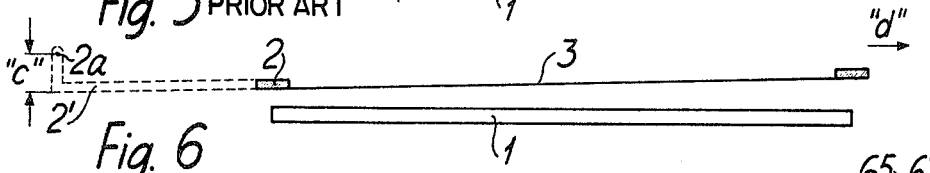
FIG. 6 illustrates a first embodiment of a means for causing movement of the stencil relative to the platen during the printing stage with a moveable squeegee.

The present invention provides several different possibilities of eliminating such geometric printing errors. To this end, as illustrated in FIG. 6, the pivot axis 2*a* of the stencil 2 is located at a distance "c" above the plane of the stencil 2. When pivoting the stencil about the axis 2*a*, the rotation causes the stencil 3 with associated frame 2 to move relative to the platen 1, this relative movement being illustrated by the arrow "d" in FIG. 6. Naturally, the frame 2 will also be lifted in the manner illustrated in FIGS. 4 and 5. Although the rotation axis 2*a* shown in FIG. 6 is located at a predetermined distance above the plane 2' of the frame 2 of the stencil 3, it will be understood that the distance "c" may be varied or regulated, either arbitrarilly or in a predetermined manner of steps.

It should be noted that the magnitude of the geometric error is primarily dependent upon the material from which the stencil 3 is made. This material may be nylon, polyester or stainless steel. Nylon is the most elastic of these materials and hence the geometric error will be greatest with a stencil made of this material, while the least elastic material is stainless steel.

Figure 7:
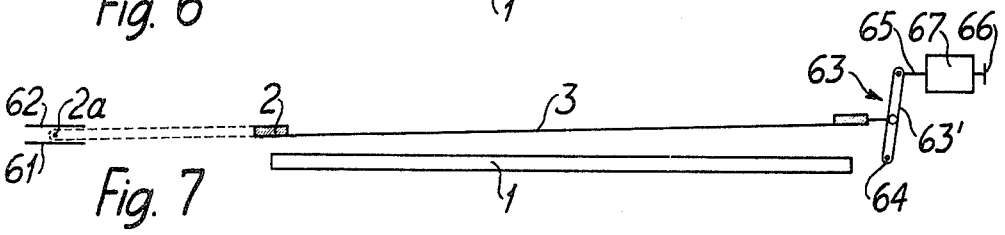
FIG. 7 is a side view of a further embodiment of a means for causing movement of the stencil relative to the platen during the printing stage with a moveable squeegee.

FIG. 7 illustrates a further embodiment in which the shaft 2*a* about which the frame 2 rotates is displaceably arranged between two horizontal guide plates 61 and 62, in which embodiment the aforementioned relative movement of the stencil with the plate 1 is obtained by means of guide means 63 arranged to guide the frame 2 as it is raised. The guide means 63 comprises parallel guide surfaces 63' one end of which is arranged for rotation about a shaft 64 and the other end of which can be adjusted via an arm 65 in a manner such as to change the angle of inclination relative to the vertical plane. This adjustment can be effected by means of a knob 66 via a known transmission arrangement 67. When the frame 2 is raised, said frame will be guided by the guide rail 63', thereby to provide the requisite relative movement of the stencil 3 with the platen 1. The shaft 2*a* is arranged for horizontal movement or substantially horizontal movement.

It should be noted that when being raised, the frame is guided by the movement and position of the squeegee in a manner such that the frame is raised a small amount at the starting position and a greater amount at the terminal position. Thus, compensation for the geometric printing error is smaller at the starting position than at the terminal position. This compensation is normally not proportional to the position of the squeegee, but varies, and hence the guide rail 63' should be slightly S-shaped.

Figure 8:
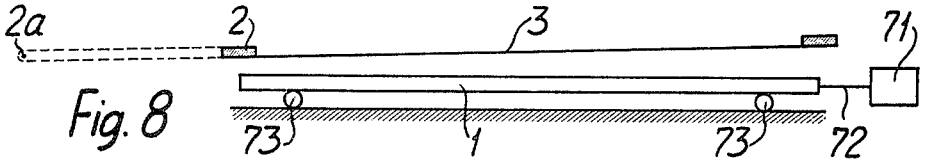
FIG. 8 illustrates a third embodiment of the invention in which the platen is arranged to be moved relative to the stencil.

In FIG. 8 there is illustrated an embodiment in which the frame 2, similarly with that shown in FIGS. 2–5, is fixedly arranged against lateral and vertical movement at the rotation points 2*a*, but in which the platen 1 is arranged to be moved and to the stencil 3 to remain stationary. To this end there is provided a means 71 which, via a shaft 72, can impart to the platen 1 the desired movement in the direction of the arrow "d" of FIG. 6. The platen 1 rests on roller bearings 73. In this embodiment, the aforementioned compensation can be controlled via known means by the movement and position of the squeegee. For the sake of clarity, the means for sensing the position of the squeegee have not been shown in the Figure, and neither have the means required for actuating the means 71 in response to the position of the squeegee.

Figure 9:
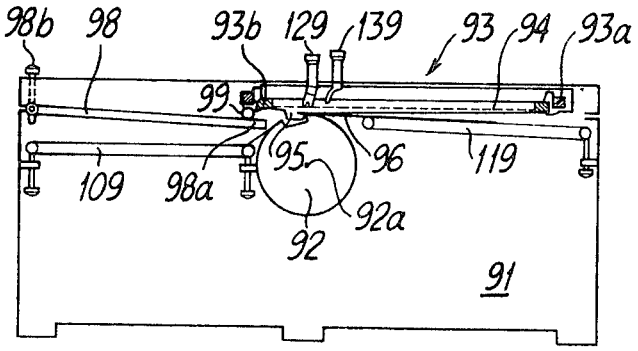
FIG. 9 is a side view in section illustrating parts of a silk-screen printer in which those parts necessary to obtain an understanding of the invention have been included, and having a fixed squeegee.

The printer illustrated in FIG. 9 has a fixed squeegee and comprises a frame 91 having bearing means which carry a reciprocatable drum 92. The drive means for the drum 92 are not shown in the drawings and do not form part of the present invention. A reciprocateingly moveable frame 93 for a stencil 94 is arranged above the drum 92, movement of the frame 93 being controlled by the movement of the drum 92. This mutual movement can be conveniently effected by means of a rack arranged on the frame 93 and a pinion arranged on the drum 92, the rack and pinion being arranged to co-act with each other. In accordance with the present invention, a gripping device 95, intended to hold the material 96 to be printed, shall be arranged in a manner such that, upon movement of the drum 92, said material moves in a path which is coincident with or located parallel with a tangent to the drum. One end of the frame 93 carrying the stencil 94 shall be arranged to move in a direction away from the movement path of the gripping device, upon movement of the drum 92.

The frame 93 comprises a body 93*a* and a frame structure 93*b*, which frame structure is intended to carry the stencil 94. The gripping device 35 is fixedly mounted to the frame body 93*a* and consequently executes a movement which corresponds directly to the movement executed by the frame body 93*a*. This movement is controlled by a track 97 which extends horizontally and coincides with or is parallel to a tangent to the drum. The frame structure 93*b* arranged within the frame body 93*a* is loose at one end thereof in relation to the frame body 93*a* and runs on a track 98 via wheels 99. The track 98 can be adjusted to different inclined positions owing to the fact that one end of the track 98 is pivotably attached to the frame body 91 via a shaft 98*a* and at its other end is held in the desired inclined position by a screw means 98*b*. Owing to the fact that the end of the track 98 remote from the drum 92 is located at a higher level than the pivot shaft 98*a*, the frame structure 93*b* will be lifted during printing, thereby to provide a suitable release angle between the material 96 and the stencil 94, even when the material 96 is moved horizontally by means of the gripping device 95. At the other end of the frame structure 93*b* there are pivot means which hold the frame structure 93*b* to the frame body 93*a*. On FIGS. 11 and 12 this pivot shaft is referenced 99.

It should be noted that the frame structure 93*b* can be caused to move horizontally relative to the frame body 93*a*, to which end pegs mounted in the frame structure 93*b* run in grooves arranged in the frame body 93*a*.

The track 97 and the track 98 comprise guide rails between which there is arranged a discharge means 109 which receive the printed material 96 subsequent to the termination of the printing stage. The gripping device 95 releases its grip on the material 96 in the position shown in FIG. 10, whereupon the material falls down onto the discharge means 109. On the other side of the drum 92 there is provided an infeed means 119 provided in a known manner with control means 119*a* for adjusting the angle at which the material 96 is moved to the gripping device 95 in the position shown in FIG. 9.

Arranged above the drum 92 on the other side of the stencil 94 there is a squeegee 129 and an ink dispenser 139 co-operating therewith, said squeegee being stationary relative to the platen and the stencil but moveable up and down. The squeegee 129 and the ink-dispenser 139 are guided by means not shown in a manner such that the squeegee 129 urges the stencil 94 against a sheet 96 for printing during the printing stage while the ink-dispenser 139 abuts the stencil 94 during the return stage.

Figure 11:
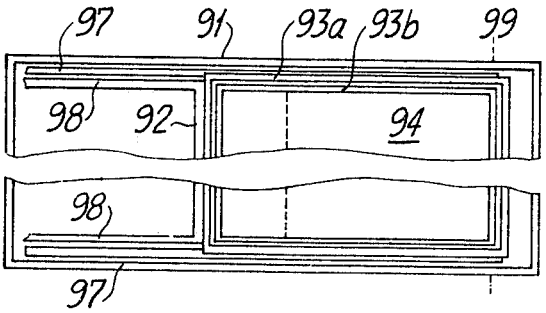
FIG. 11 illustrates the printer shown in FIG. 9 at the end of a printing stage.
Figure 12:
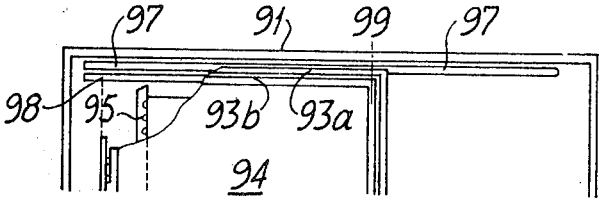
FIG. 12 is a horizontal view of the printer in the position shown in FIG. 11.

By providing the guide rails 98 or the guide tracks 98 and the guide rails 91 or the guide tracks 97, it is possible to ensure a satisfactory release angle between the stencil 94 and the sheet 96 to be printed, even when the rear portion of the sheet 96 is to be printed in accordance with FIG. 11.

Figure 10:
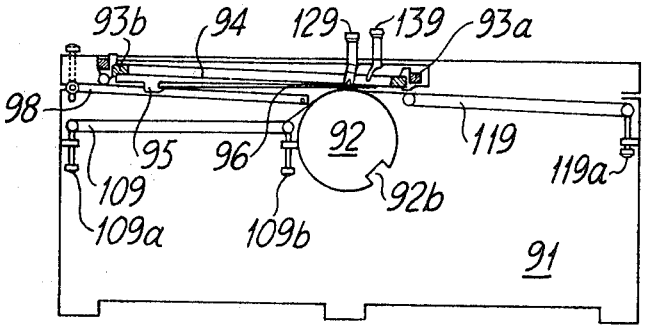
FIG. 10 is a horizontal view of the printer shown in FIG. 9.

In the illustrated embodiment of FIG. 10, the drum 92 is provided with a recess 92*b* for receiving the gripping means 95, although it will be understood the gripping devices may be replaced by other structural devices having the same function. Further the drawing shows that the infeed means is provided with a control means 119*a*, and similarly the discharge means 109 may be provided with similar control means 109*a* and 109*b* in order thereby to obtain the desired co-operation between the sheet 96 and the discharge means 109 when the sheet 96 falls onto the discharge means 109 subsequent to the printing stage.

Figure 13:
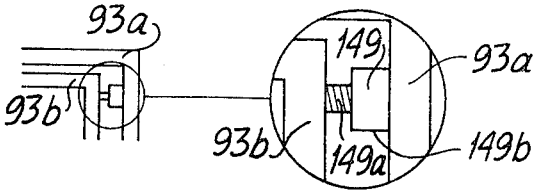
FIG. 13 illustrates in larger scale means for causing the material to be printed to move relative to the platen.

FIG. 13 illustrates how the frame structure 93*b* can be caused, during the printing stage, to move relative to the frame body 93*a*. Arranged between the frame structure 93*b* and the frame body 93*a* are a number of servo motors 149 (two in number) each of which drive a spindle 149*a*. The servo motors 149 are fixedly attached to the frame body 93*a* and are screwed to the frame structure 93*b* by means of spindles 149*a*.

The servo motors are connected via a line 149*b* with means (not shown) for generating a signal in response to the position of rotation of the drum 92. In this way, the servo motors can be activated in dependence upon the position of the stencil, thereby to compensate for the geometric printing error.

The invention is not restricted to the described embodiments but can be modified within the scope of the following claims.

I claim:

1. An improved silk-screen printer of the type employing a squeegee and means for urging the squeegee against a stencil and a material to be printed wherein any stretch in the stencil resulting from the pressure of the squeegee thereon may be compensated for by imparting movement to the stencil relative to the material to be printed, said silk-screen printer comprising:

a stationary platen having a printing surface associated therewith;

a frame spaced from and located above the stationary platen and having a stencil mounted therein, said stencil being comprised of an elastic material;

means for dispensing ink to a surface of said stencil;

a squeegee;

means for urging said squeegee against the stencil so as to provide contact between said stencil and said printing surface; and said stencil frame being pivotably attached to one end about a shaft with the pivot axis of said stencil frame being located above the horizontal plane of said frame, an opposite end of said frame being capable of movement in a vertical plane so as to allow the frame to pivot about said axis.

2. An improved silk-screen printer of the type employing a squeegee and means for urging the squeegee against a stencil and a material to be printed wherein any stretch in the stencil resulting from the pressure of the squeegee thereon may be compensated for by imparting movement to the stencil relative to the material to be printed, said silk-screen printer comprising:

a stationary platen having a printing surface associated therewith;

a frame spaced from and located above the stationary platen and having a stencil mounted therein, said stencil being comprised of an elastic material;

means for dispensing ink to a surface of said stencil;

a squeegee;

means for urging said squeegee against the stencil so as to provide contact between said stencil and said printing surface;

one end of said frame being displaceably arranged between guide plates;

an opposite end of said frame along the longitudinal axis thereof being connected to pivot means having one end pivotably attached to a shaft so as to permit rotation of the pivot means about an axis which is parallel with the lateral axis of said frame and above the horizontal plane thereof, the other end of said pivot means being connected to adjustment means whereby the angle of inclination of the pivot means relative to a vertical plane can be varied; and said frame being connected to said pivot means at such a point and said guide means being positioned relative to said stationary platen such that the frame is spaced from and located above the stationary platen.

3. An improved silk-screen printing apparatus comprising:

a silk-screen printer frame having bearing means which supports a reciprocateable drum;

drive means for said drum to impart reciprocateable movement thereto;

a reciprocatingly moveable stencil frame having a stencil mounted therein, said stencil frame being mounted above said drum and within said silk-screen printer frame;

said drum and stencil frame cooperating so that movement of said drum also imparts movement to said frame in a path consistent with and parallel to a tangent of said drum;

said stencil frame being moveably mounted on guide means, which means are pivotably mounted within said printer frame so as to allow the level of inclination of said guide means to be varied;

a squeegee mounted above said drum and positioned to engage the stencil at a point where the stencil engages said drum; and means within said stencil frame with which to provide movement of the stencil mounted therein in the direction of said reciprocateable movement.

4. An improved silk-screen printer of the type employing a squeegee and means for urging the squeegee against a stencil and a material to be printed wherein any stretch in the stencil resulting from the pressure of the squeegee thereon may be compensated for by imparting movement to the stencil relative to the material to be printed, said silk-screen printer comprising:

a stationary platen having a printing surface associated therewith;

a frame spaced from and located above the stationary platen and having a stencil mounted therein, said stencil being comprised of an elastic material;

means for dispensing ink to a surface of said stencil;

a squeegee;

means for urging said squeegee against the stencil so as to provide contact between said stencil and said printing surface; and means with which to impart movement to said stencil relative to the material to be printed upon during the printing step.

* * * * *